United States Patent [19]

Hofmann

[11] 4,053,108

[45] Oct. 11, 1977

[54] DEVICE FOR LATERAL LIMITING TRAFFIC MARKING LINES

[76] Inventor: Walter Hofmann, An der Flottbek, Hamburg, Germany, 2000

[21] Appl. No.: 730,569

[22] Filed: Oct. 7, 1976

[30] Foreign Application Priority Data

Oct. 4, 1975 Germany ..... 2544478

[51] Int. Cl.[2] ..... B05B 1/28; B28B 19/00

[52] U.S. Cl. ..... 239/150; 425/87; 401/48; 118/305

[58] Field of Search ..... 425/87; 401/48, 137; 15/103.5; 118/305; 239/150, 151, 296, 188.3, 188.5

[56] References Cited

U.S. PATENT DOCUMENTS

| | | | |
|---|---|---|---|
| 2,220,316 | 11/1940 | Creswell | 239/151 |
| 3,122,773 | 3/1964 | Little | 401/48 |
| 3,239,147 | 3/1966 | Sweet | 239/150 |

FOREIGN PATENT DOCUMENTS

| | | | |
|---|---|---|---|
| 326,093 | 1/1958 | Switzerland | 239/151 |

*Primary Examiner*—Ronald J. Shore
*Assistant Examiner*—John S. Brown
*Attorney, Agent, or Firm*—Allison C. Collard

[57] ABSTRACT

An apparatus for applying road marking lines to a roadway which includes a pair of spaced plates movable with the apparatus to guide the line width. The spaced plates are also provided with a gas outlet opening to guide the marking material away from the plates onto the roadway to be marked.

10 Claims, 6 Drawing Figures

DEVICE FOR LATERAL LIMITING TRAFFIC MARKING LINES

BACKGROUND OF THE INVENTION

This invention relates to an apparatus for applying road marking lines onto a roadway and includes a device for obtaining an exact lateral limiting of the marking lines which are applied onto the roadway by means of spray guns so as to control the width of the lines and provide a fine and uniform finished edge.

The device generally includes slide plates which are mounted at both sides of the spray gun spaced in accordance with a width desired by the operator for a given marking line and which slide on the roadway. In accordance with the invention, air slots are provided on the slide plates through which the material sprayed onto the roadway is blown off.

DESCRIPTION OF THE PRIOR ART

In known road marking machines, the sprayed on material is directly applied onto the roadway without using any lateral limiting means. This results in very poor line uniformity width and control. First of all, the material is somewhat dissolved in the lateral direction due to the air pressure of the spray gun which results in a poor inexact and drop-like lateral limit of the marking lines which do not look very esthetic and are subject to rapid wear and tear from the outside. Furthermore, the marking line does not run straight as required, but curvilinear, which is caused by the wide fluctuations of the fan-like application of the material and the uneveness of the roadway.

In known devices, roller discs are used which are mounted at both sides of the spray gun. These discs roll on the roadway whereby the applied material hits the edge of the roller discs. This results in an exact lateral limitation of the marking lines. However, a large quantity of material is lost with this method, because the material which hits the roller discs must be wiped from the discs. The wiped material is then collected in a container, and it cannot be used as line marking material. This container must be emptied after a short operating time which interrupts the line marking operation. Other interruptions in the operation may occur as a result of the necessity to clean the roller discs and the wiper elements, depending on the position of the spray gun.

SUMMARY OF THE INVENTION

The subject invention is advantageous over the known devices. In view of the fact that the sprayed material which would tend to hit the slide plates is blown off by the blown air from the air slots, whereby the material is applied exclusively onto the marking line and a first-class lateral line etching is obtained. While air is blown from the air slots, these slots can be used with any type of gas compatible with the line marking material. The exhaust gas from a gas burner may also be used for certain applications. The term "gas" is intended to include air or gas from the exhaust from a gas burner, or any gas compatible with the line marking material which is to be applied to a roadway. The terms "air" and "gas" can generally be used interchangeably in the understanding of the invention, and air and gas may also be physically used interchangeably depending upon the material to be applied. It is essential that the marking lines limitation show a very definitely defined line etching. This is obtained as a result of the use of the combination of the sliding plates together with the blown air which is used to push back the line material to apply it to the roadway between the plates. The life span of the marking lines is substantially increased as a result of this unique application. Marking lines having an enforced and well-defined edge can easily be reworked, because the edges have a longer life span than the center section of the marking line, whereby the reworking marking machine may use these line edges as a line of sight. It should also be noted that the maintenance of the new machine is simpler than the maintenance of the machine with the roller discs.

Accordingly, an object of the invention is to provide an apparatus for applying road marking material which has well-defined edges and which can be easily repaired.

Other objects and the nature of the invention will be readily understood from a detailed description of the preferred embodiments of the invention in which like parts have the same reference numerals.

BRIEF DESCRIPTION OF THE DRAWING

FIG. 4 is a view looking in the direction of arrow IV in FIG. 6;

DESCRIPTION OF THE PREFERRED EMBODIMENTS

Figure 1:
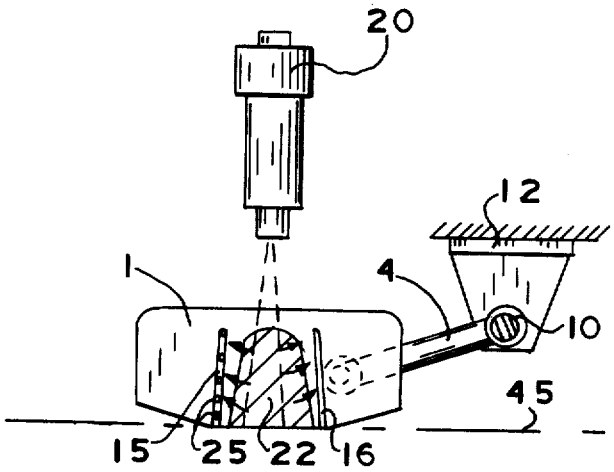
FIG. 1 is a schematic side view of one embodiment of the invention and the slide plates looking in the direction of the arrow I in FIG. 2.
Figure 2:
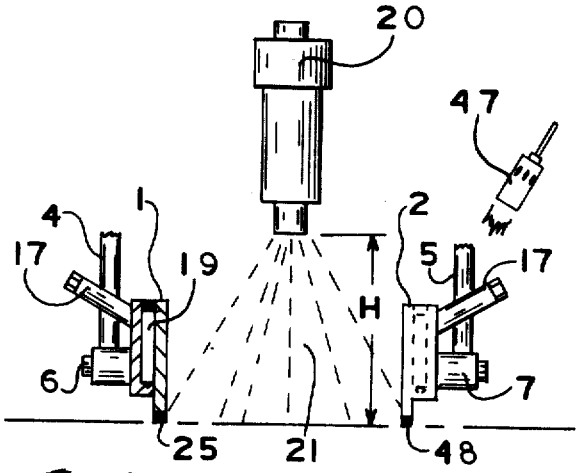
FIG. 2 is a front view of the apparatus in accordance with the invention showing the slide plates in a front view in the direction of movement of the apparatus. The slide plates are shown spaced in accordance with the width of the line to be made.
Figure 3:
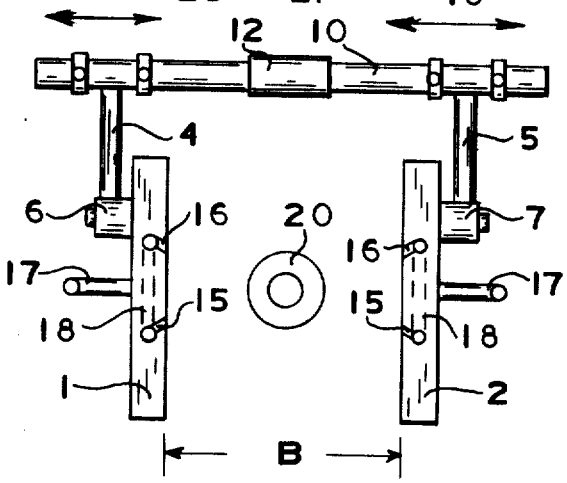
FIG. 3 is a plan view looking in the direction of arrow III of FIG. 2.

Referring to the drawing, and particularly to FIGS. 1-3, apparatus for painting marking lines onto roadway 45 includes a pair of sliding plates 1 and 2 connected with arms 4 and 5 and supported on pinions 6 and 7. Lateral rod 10 is carried by a machine frame, and the swinging arms 4 and 5 are laterally displaceable along lateral rod 10 for adjusting the width of marking line B which is the distance between plates 1 and 2. Lateral rod 10 is mounted in machine frame 12, whereby the bar is liftable and movable in downward direction in a parallelogram.

In accordance with the invention, air supply devices in the form of vertical air slots 15 and 16 are provided at or in the slide plates and are fed through air sockets or connectors connected with the plates to the air slots 17 through bores or passages 18, 19. The quantity of the air flow may be adjusted by an air reducing means in the usual manner (not shown) which is of importance when working with different types of indicia marking materials, such as paint, spray plastic, etc. Adjustable spray pistol or gun 20, which sprays the material in a known fan-like fashion due to differently shaped nozzles, is mounted on the apparatus between slide plates 1 and 2 and at an adjustable height H above the roadway 45, whereby the height is so adjusted that the material which is spread out in the form of a fan as noted by lines 21 still hits the lower area or paint admission face 22 of the slide plates. Normally, the material collected on the slide plate at this point would result in overflooding of the slide plates in a few seconds, and this would cause very unclean lateral edges of the marking lines. Furthermore, at the separation points between the individual marking lines, strips of paint would be drawn or run between the individual marking lines. The air which flows through air slots 15 and 16 distributes the collected material at the side plate onto the face of the marking line with the assistance of the spray gun air which moves in all directions as noted by arrows 22, that is, also in the direction of the air slots 15, 16. Hence, a collection of the paint material onto the slide plates, with all the disadvantages consequences, is prevented.

It is possible, when taking into consideration the different types of materials, to adjust air slots 15 and 16 laterally as can be seen from FIG. 1, or as can be seen from FIG. 3 to adjust the slots in the direction toward the spray gun, as on plate 2, or away therefrom, as on plate 1. If, for example, the two air slots are directed toward the spray gun as shown on plate 2 in FIG. 3, one obtains a smaller fan-like distribution of the spray material, whereby the quantity of the material which hits the slide plates would be reduced. Positive effects may also be obtained if a series of apertures 25 (see FIG. 1) are provided instead of slots, whereby the individual apertures 25 may be directed downwardly so as to even better apply the paint material or indicia marking material onto the line to be marked and at the shortest path possible. In addition, the plates assist in preventing the marking material from seeping between the plates and the roadway to assure the obtention of a fine edge for the road markings.

Figure 4:
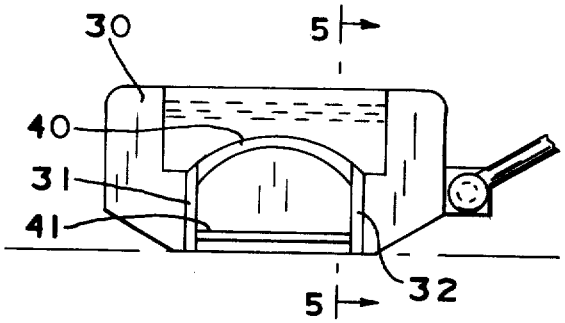
FIG. 4 is a partial schematic view of another embodiment of the invention, with parts similar to the FIGS. 1-3 embodiment omitted for purposes of simplicity.
Figure 6:
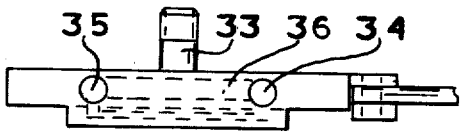
FIG. 6 is a plan view looking in the direction of arrow VI in FIG. 4.

Another embodiment of the invention is shown in FIGS. 4 and 6 in which for purposes of simplification only one slide plate is shown; it is understood that the apparatus is symmetrical and includes two slide plates as in the FIGS. 1–3 embodiments. Also, parts for lifting and moving the slide plate is not shown, but is placed in the same manner as shown with the FIGS. 1–3 embodiment. Slide plate 30 is provided with two vertically arranged air slots 31 and 32 generally similar to slots 15 and 16. Air pressure is fed through air sockets 33 and supplied through bores or passages 34, 35 and 36 to slots 15 and 16. Apertures 25 can also be used instead of air slots 15 and 16. Furthermore, two additional air blowing slots are provided, namely, an upper curved-like slot 40 and a lower lateral slot 41. Slot 40 is directed downwardly and because of its direction, prevents the admission of material onto the slide plate to a great extent because a large portion of the material which drops from the fan of material is diverted downwardly by the blown air and does not reach the slide plate. The less material that reaches the slide plate, the less material that can accumulate on the slide plate, so that the air slots are able to remove all of the remaining paint material from the slide plate onto the marking line.

Figure 5:
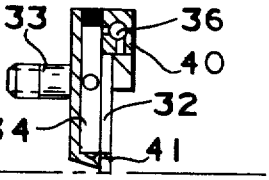
FIG. 5 is a sectional view taken on line V—V of FIG. 4.

A similar purpose is accomplished by air blowing slot 41 which runs parallel to roadway 45 so as to prevent the formation of a shoulder, if so desired. With air blowing slots 40 and 41, it would be advantageous when working with certain material not to direct the direction of air flow parallel with respect to the roadway 45, but rather obliquely downwardly towards the roadway as shown in FIG. 5. Furthermore, the quantity of air which is emitted from these slots may be adjusted depending on what type of painting material is used, by adjusting the width of the slot, for example.

Instead of compressed air which is generated by a compressor, the exhaust gas of gas burners may be used so that the slide plates are brought to high temperatures, as is required when working with hot paints, for example, spray plastic.

Another means to heat the slide plates in such a manner that sprayable thermoplastic material does not harden on the slide plates is to use gas burners 47, as shown in FIG. 2, obliquely across the back side of the slide plates. However, the arrangement of the burners may be randomly arranged. A complete self-cleaning of the slide plates, in particular at the paint admission face 22, may be obtained in that the plates are brought to such a high temperature that all material residues burn off. Hard metal bars 48 may be used on the bottom for the gliding edges of the slide plates so as to prevent wear and tear on the same and further insuring that the paint stays between the plates and does not seep past the plates.

While there has been shown what are considered to be the preferred embodiments of the invention, it will be obvious to those skilled in the art that various changes and modifications may be made therein without departing from the scope of the invention.

I claim:

1. Apparatus for applying road marking lines onto a roadway and limiting the lateral extent thereof and thereby control the width and edge finish of the lines, comprising:

a frame;

an adjustable spray gun operatively associated with said frame for applying spray road marking indicia material onto the roadway;

a pair of oppositely disposed sliding plates coupled to said frame, said plates being positioned on opposite sides of said spray gun and laterally separated in distance in accordance with the width of the lines to be marked on the roadway, said plates being adjustable laterally to vary the lateral spacing therebetween to vary the width of the lines to be marked, said plates being slidable on the roadway in contact therewith to assure obtention of a fine edge for the road marking; and gas supply devices connected with said sliding plates for supplying blowing gas for blowing the spray road marking indicia material away from said sliding plates and onto the roadway between said sliding plates and onto the marking lines.

2. The apparatus as defined in claim 1, said gas supply devices include slots in said sliding plates for supplying the blowing gas.

3. The apparatus as defined in claim 2, said gas supply devices include an air supply, an upper curved and a lower horizontal laterally extending slot in said sliding plates, air connectors for said sliding plates connected with said air supply, bores in said plates rendering said air connectors in communication with said slots for supplying blown air to said slots which cooperate with each other to cause the road marking indicia to move away from said plates and to be applied between said plates onto the roadway.

4. The apparatus, as defined in claim 1, said gas supply devices include an upper curved-like slot and a lower lateral slot in said sliding plates.

5. The apparatus as defined in claim 1, said gas supply devices include connectors connected with said plates, passages in said plates connected with said connectors, vertical slots, in said plates, and an upper curved and lower horizontal slots in said plates connected with said connectors through said passages for supplying the blowing gas.

6. The apparatus as defined in claim 5, including a gas burner to supply exhaust gases to provide the blowing gas to said connectors.

7. The apparatus as defined in claim 5, including gas burners for directly heating said slide plates, said spray gun supplying thermoplastic marking indicia, and said gas burners preventing hardening of the thermoplastic material to obtain a complete cleaning of said slide plates by burning off the adhering material.

8. The apparatus as defined in claim 1, said gas supply device include an air supply for supplying air, adjustable nozzles on said sliding plates facing inwardly and adjustable to alter the direction of the marking indicia material, an upper curved slot and a lower lateral slot in said sliding plates cooperating with said adjustable nozzles.

9. The apparatus as defined in claim 1, including metal bars on the bottom of said sliding plates forming gliding edges therefor.

10. The apparatus as defined in claim 1, said gas supply devices include adjustable nozzles on said sliding plates facing inwardly and adjustable to alter the direction of the marking indicia material.

* * * * *